US007578219B2

(12) United States Patent
Wu

(10) Patent No.: US 7,578,219 B2
(45) Date of Patent: Aug. 25, 2009

(54) ADJUSTABLE SPANNER WITH ELECTRONIC STRAIN GAUGE FUNCTION

(75) Inventor: Arthur Wu, Taichung (TW)

(73) Assignee: Proxene Tools Co., Ltd., Taichung (TW)

( * ) Notice: Subject to any disclaimer, the term of this patent is extended or adjusted under 35 U.S.C. 154(b) by 0 days.

(21) Appl. No.: 12/205,355

(22) Filed: Sep. 5, 2008

(65) Prior Publication Data

US 2008/0314208 A1 Dec. 25, 2008

Related U.S. Application Data

(63) Continuation-in-part of application No. 11/394,246, filed on Mar. 31, 2006, now abandoned.

(51) Int. Cl.
*B25B 13/34* (2006.01)
*B25B 13/16* (2006.01)

(52) U.S. Cl. ..... 81/165; 81/179

(58) Field of Classification Search ..... 81/165, 81/170, 179, 467, 483, 59.1, 186; 73/862.21; 269/86, 87.2
See application file for complete search history.

(56) References Cited

U.S. PATENT DOCUMENTS 3,717,054 A * 2/1973 Thompson ..... 81/179
5,595,098 A * 1/1997 Malkin et al. ..... 81/165
5,894,768 A * 4/1999 Malkin et al. ..... 81/165
5,960,683 A * 10/1999 Malkin et al. ..... 81/165
6,021,694 A * 2/2000 Beger ..... 81/483
6,119,562 A * 9/2000 Jenkins ..... 81/479
6,848,343 B2 * 2/2005 Wu ..... 81/170
6,931,969 B2 * 8/2005 Hsien ..... 81/467
7,111,529 B2 * 9/2006 Pradelski ..... 81/179
7,255,026 B1 * 8/2007 Lee ..... 81/179
2006/0196320 A1 * 9/2006 Hung et al. ..... 81/133

* cited by examiner

*Primary Examiner*—Lisa M Caputo
*Assistant Examiner*—Jonathan Dunlap
(74) *Attorney, Agent, or Firm*—Banger Shia

(57) ABSTRACT

An adjustable spanner with electronic strain gauge function which comprises a head; an fixed jaw extending from the head; and sliding groove being transversally formed at one upper side of the head; a handle connected to a lower side of the head; at least one strain gauge; a hollow connecting tube having one end connected to the handle; the hollow connecting tube being installed with an output display device; a clamping surface of the moveable jaw and a clamping surface of the fixed jaw being formed as a working area for clamping a screw device; and a positioning portion being installed on the moveable jaw and at a non-working area below the working area; the position portion facing toward a clamping opening between the clamping surfaces of the moveable jaw and fixed jaw; and the positioning portion being capable of resisting against the screw device.

10 Claims, 8 Drawing Sheets

ADJUSTABLE SPANNER WITH ELECTRONIC STRAIN GAUGE FUNCTION

This application is a Continuation in Part (CIP) of previously U.S. application Ser. No. 11/394,246, and which claims the priority of the filing date of Mar. 31, 2006, and Claims 1-10 in the current CIP application correspond to Claims 1-10 in the parent application, respectively, and are entitled to the parent application's filing date of Mar. 31, 2006.

FIELD OF THE INVENTION

Background of the Invention

Referring FIGS. 11 and 12, U.S. Pat. No. 5,595,098 discloses a conventional tool having jaws for gripping hexagonally shaped objects comprises a fixed jaw and a movable jaw, wherein the fixed jaw includes three clamping surfaces, and the movable jaw includes two retaining surfaces comprised of an extending plane and a bottom such that as in use, the tool can clamp at least fourth sides of a hexagonal screw means.

In operation, the movable jaw of the conventional tool allows to clamp the screw means by its two retaining surfaces, the reinforcing rib is extended from the bottom surface to the teeth and connected in a parallel manner, accordingly not only the large-size or tetragonal screw means can not be clamped, but also the movable jaw can not be adjusted inwardly to clamp a small-size screw means. Besides, the reinforcing rib is not strong enough to rotate the screw means effectively.

Furthermore, the adjustable spanner with electronic strain gauge function, such as those disclosed in Taiwan Patent No. M241180, strain sensors are adhered on the clamping surfaces of the fixed jaw and moveable jaw of an adjustable spanner. A display is adhered to the handle. The defect of this design is that the precision of the strain sensors will be deteriorated due to the pressure from a screw means. Furthermore, when the size of the screw means to be measured is changed, the clamping positions of the adjustable spanner to the screw means will also changed. Thus the precision of the measuring strain will not be retained. This is because the respect relations of the edges and sides of the moveable jaw, fixed jaw and the screw means are changed. Thus the twisting force measured is not accurate.

SUMMARY OF THE INVENTION

The primary object of the present invention is to provide an adjustable spanner with an electronic strain gauge function that the central point where the positioning portion engages the screw device is nearly equal to the central point of the strain gauge.

Another object of the present invention is to provide an adjustable spanner with an electronic strain gauge function that the structure strength of the positioning portion can be greatly enhanced by the reinforcing rib.

To achieve above objects, the present invention provides an adjustable spanner with electronic strain gauge function which comprises a head; an fixed jaw extending from the head; and a sliding groove being transversally formed at one upper side of the head;

a handle connected to a lower side of the head;

at least one strain gauge;

a hollow connecting tube having one end connected to the handle; the hollow connecting tube being installed with an output display device having an operation unit and a display;

a power source supplying power to the output display device; the output display device being electrically connected to the strain gauges;

a moveable jaw being comprised of an engaging surface, a sliding rod, and a reinforcing rib, a fixed positioning portion being extended from the engaging surface to face the opening between the fixed jaw and the moveable jaw so that a working area is formed among the engaging surface of the moveable jaw, the positioning portion and one side of the fixed jaw so as to clamp different-size screw means, a non-working area being located below the working area of the moveable jaw, and the reinforcing rib being extended downward from the positioning portion of the non-working area, so as to locate the positioning portion between the engaging surface of the moveable jaw and the reinforcing rib;

a sliding rod being received at the sliding groove of the fixed jaw so that the movable jaw can be adjusted to move toward or far away from the fixed jaw such that the distance between the fixed jaw and movable jaw can be adjusted randomly; wherein the distance from the connection of the positioning portion to the engaging surface of the moveable jaw is L, and the widest opening between the side of the fixed jaw and the engaging surface of the moveable jaw is S, the ratio of L to S is no more than 22%;

the height from the connection of the positioning portion and the engaging surface of the moveable jaw to a slidable slot is H, the ratio of H to S is within 35% to 49%.

The various objects and advantages of the present invention will be more readily understood from the following detailed description when read in conjunction with the appended drawing.

DETAILED DESCRIPTION OF THE INVENTION

Figure 1:
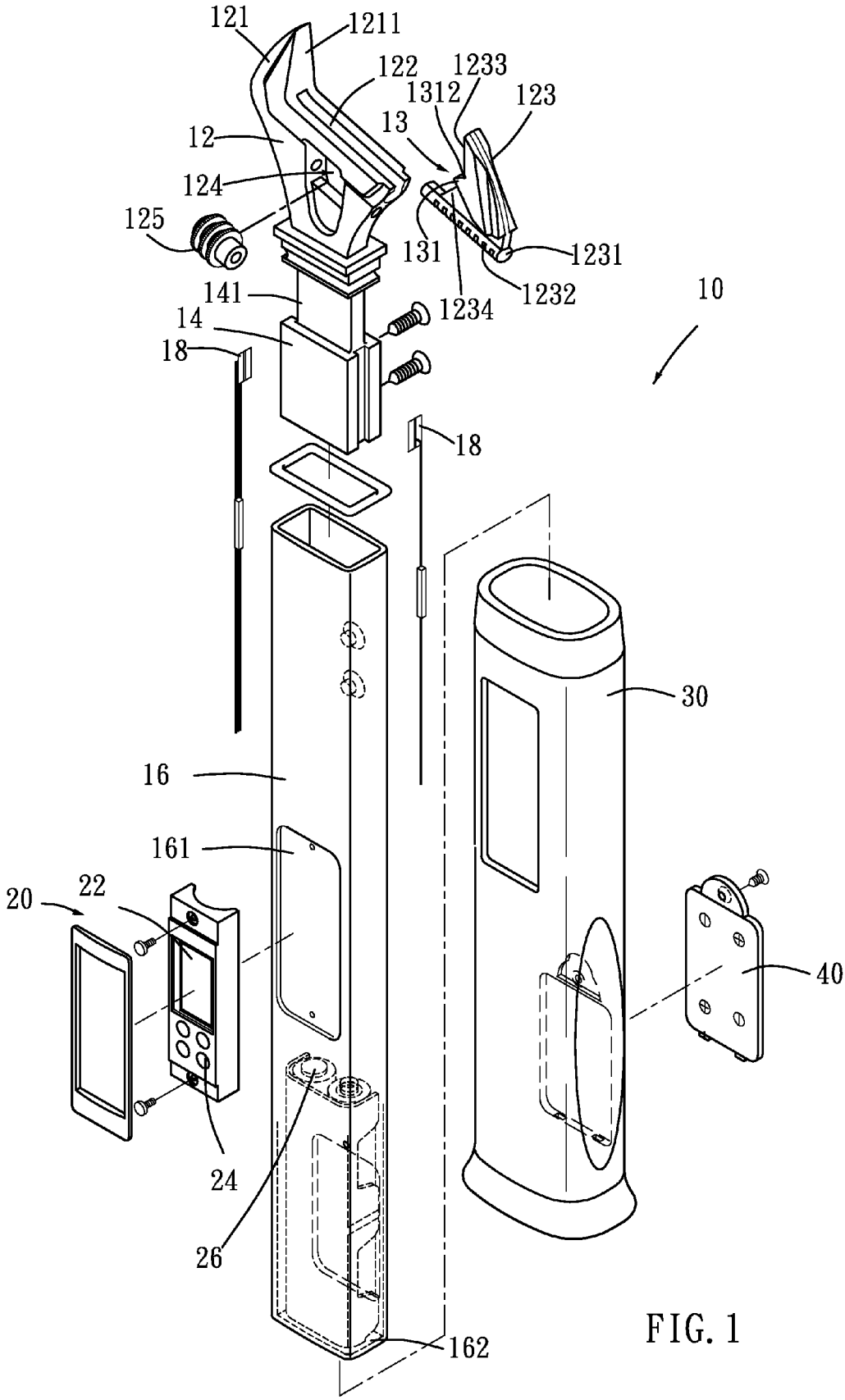
FIG. 1 is an exploded cross sectional view of the adjustable spanner with electronic strain gauge function of the present invention.
Figure 2:
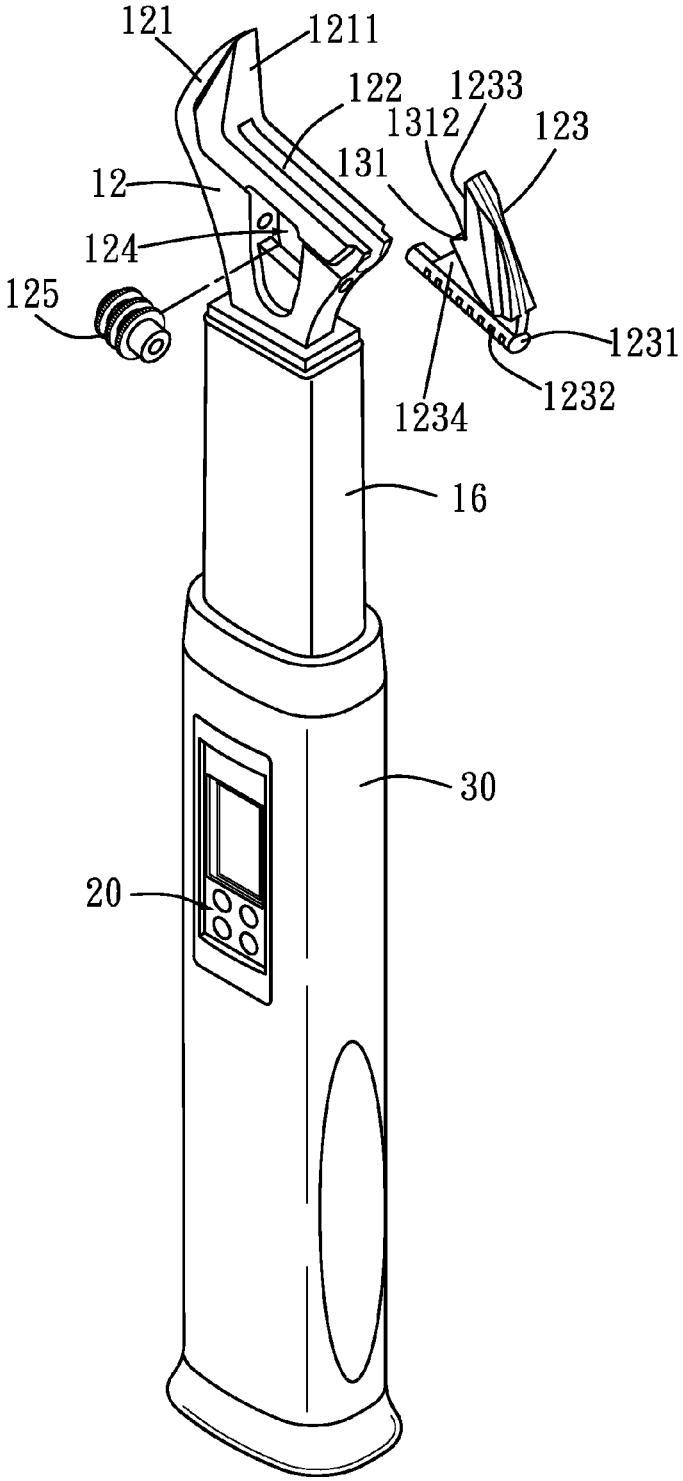
FIG. 2 is a perspective view about the adjustable spanner with electronic strain gauge function of the present invention.
Figure 4:
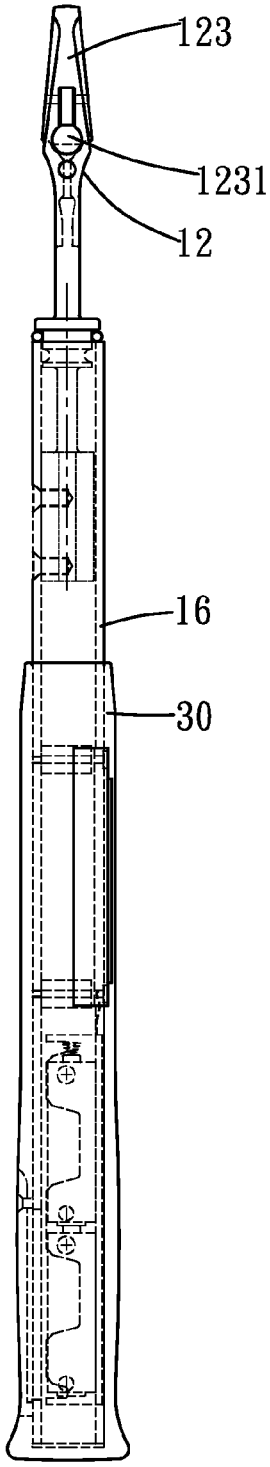
FIG. 4 is a lateral perspective view of the adjustable spanner with electronic strain gauge function of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 4, the adjustable spanner with electronic strain gauge function of the present invention is illustrated. The present invention has the following element.

A body 10 has a head 12, a long handle 14 and a hollow connecting tube 16 for receiving the long handle 14. The handle 14 has a neck 141. Two sides of the neck 141 have strain gauges 18. One side of the hollow connecting tube 16 is formed with an opened first receiving groove 161 for receiving an output display device 20 with at least one operation unit (not shown). One end surface of the output display device 20 has a display 22 for display the strain gauge value and control buttons 24 for calibration, setting, etc. The output display device 20 is electrically connected to the strain gauges 18 at two sides of the neck 141. One end of the hollow connecting tube 16 far away from the handle 14 has a second receiving groove 162 for receiving a power source 26, such as a battery or a charger. A plastic sleeve 30 serves to enclose the hollow connecting tube 16 for sealing the hollow connecting tube 16 and causing the user feel comfortable as the user holds the handle 14. The second receiving groove 162 is covered by a cover 40 for sealing the second receiving groove 162.

One side of the head 12 of the body 10 is extended with a fixed jaw 121 and another side of the head 12 is formed with a transversal sliding groove 122 for receiving a sliding rod 1231 at the sliding groove 122 in a lower side of the fixed jaw 121. The sliding rod 1231 has teeth 1232 at a lower side thereof. Two lateral sides of the head 12 are penetrated by a positioning groove 124 which is communicated to the sliding groove 122. The threaded rod 125 is received in the positioning groove 124. The threaded rod 125 is engaged to the teeth 1232 of the sliding rod 1231. Thereby when the threaded rod 125 is rotated, the moveable jaw 123 in the sliding groove 122 will move toward or far away from the fixed jaw 121. Thereby the opening between the moveable jaw 123 and the fixed jaw 121 is adjusted. The moveable jaw 123 is comprised of an engaging surface 1233, the sliding rod 1231, and a reinforcing rib 1234, a positioning portion 13 is extended from the engaging surface 1233 to face the opening between the fixed jaw 121 and the moveable jaw 123 so that a working area is formed among the engaging surface 1233 of the moveable jaw 123, the positioning portion 13, and one side 1211 of the fixed jaw 121 so as to clamp different-size screw means.

Figure 3:
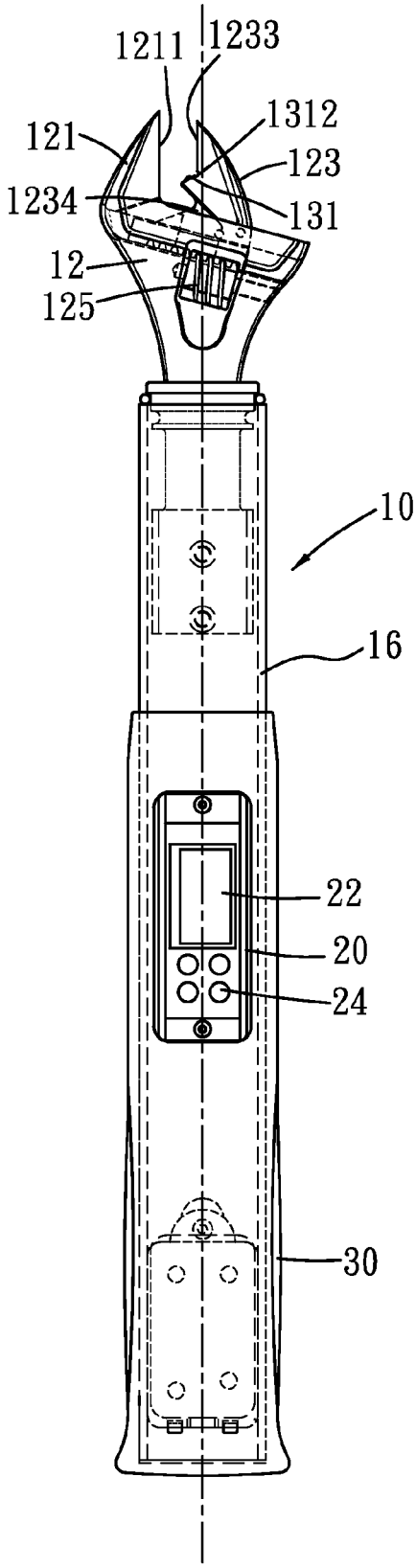
FIG. 3 is a front perspective view of the adjustable spanner with electronic strain gauge function of the present invention.
Figure 3A:
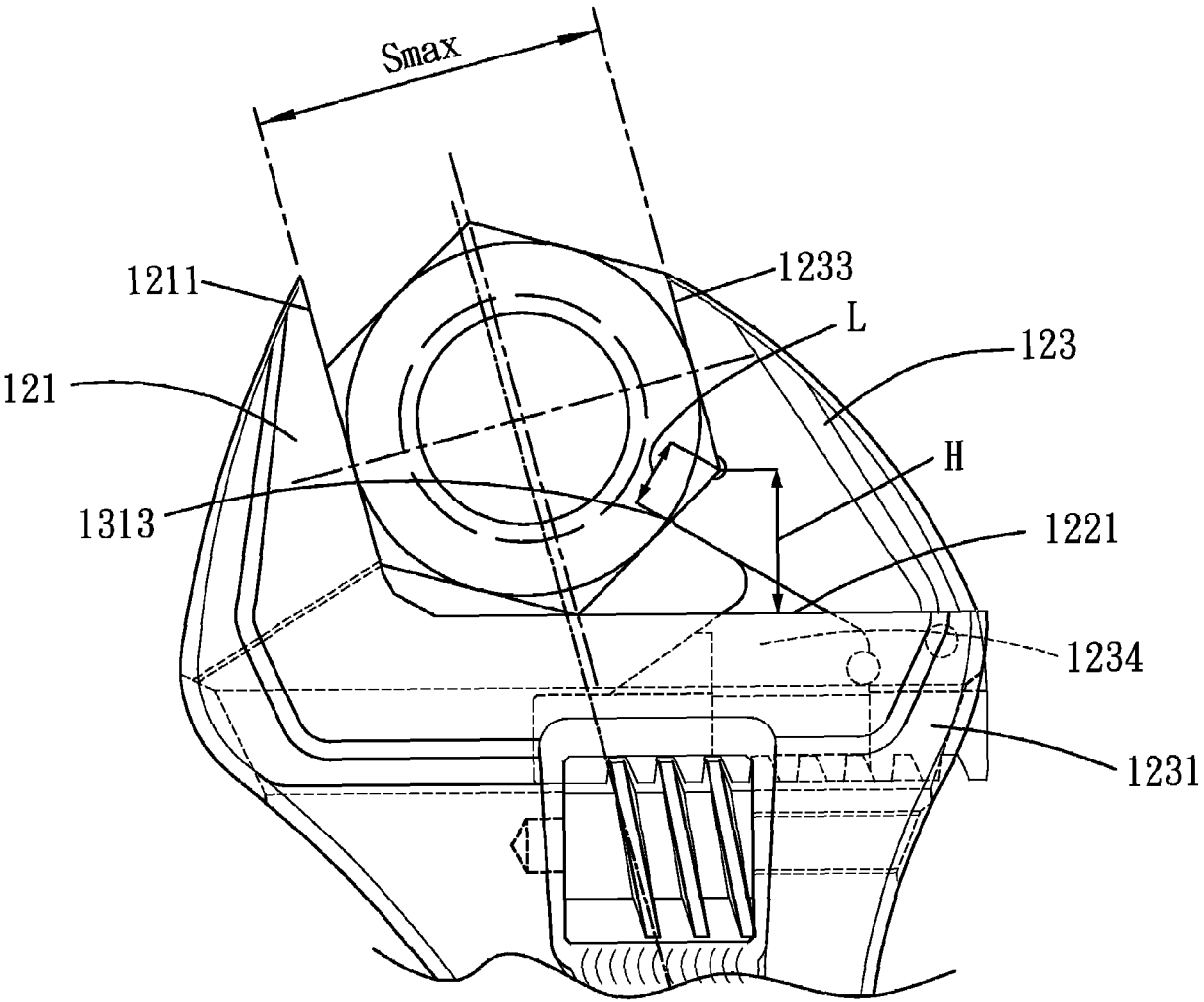
FIG. 3A is a partial enlarged view of FIG. 3.

Referring to FIG. 3A, a non-working area is located below the working area of the moveable jaw 123, and the reinforcing rib 1234 is extended downward from the positioning portion 13 of the non-working area, so as to locate the positioning portion 13 between the engaging surface 1233 of the moveable jaw 123 and the reinforcing rib 1234, wherein the distance from the connection of the positioning portion 13 to the engaging surface 1233 of the moveable jaw 123 is L, and the widest opening between the side 1211 of the fixed jaw 121 and the engaging surface 1233 of the moveable jaw 123 is S, the ratio of L to S is less than or equal to 22%.

The height from the connection of the positioning portion 13 and the engaging surface 1233 of the moveable jaw 123 to a slidable groove 1221 is H, the ratio of H to S is within 35% to 49%.

Figure 7:
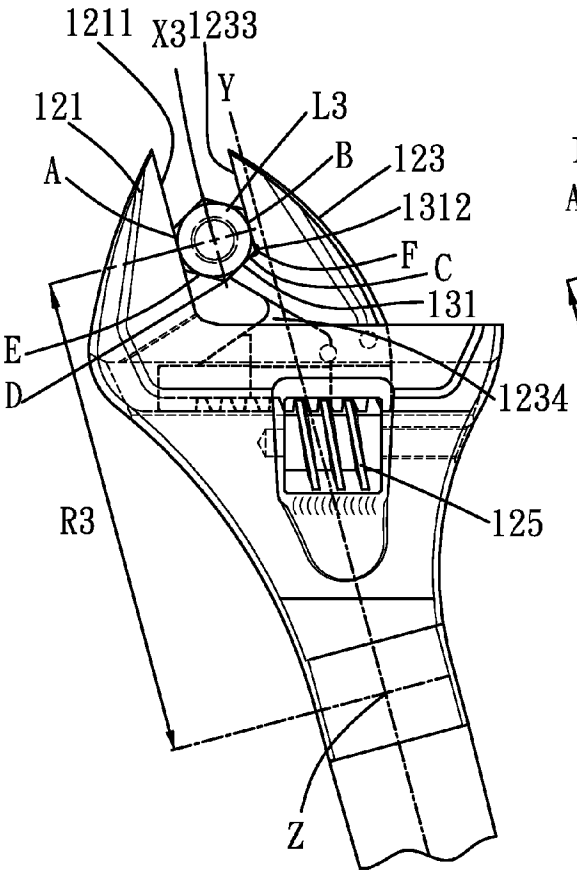
FIG. 7 shows the use of the present invention, where a screw device of 13 mm is applied to the adjustable spanner.
Figure 8:
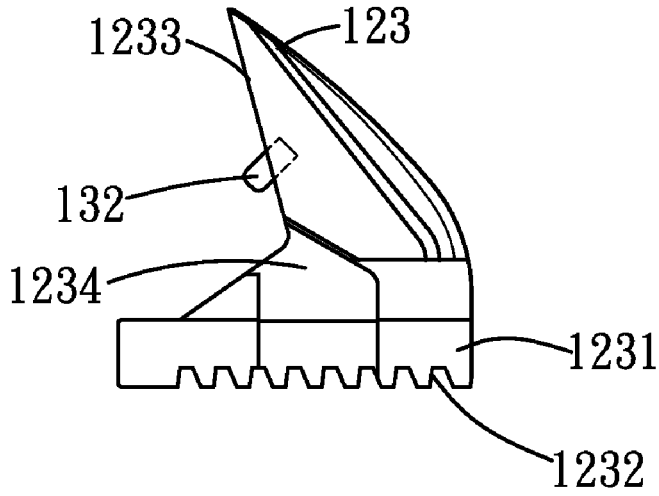
FIG. 8 shows another embodiment of the present invention.
Figure 9:
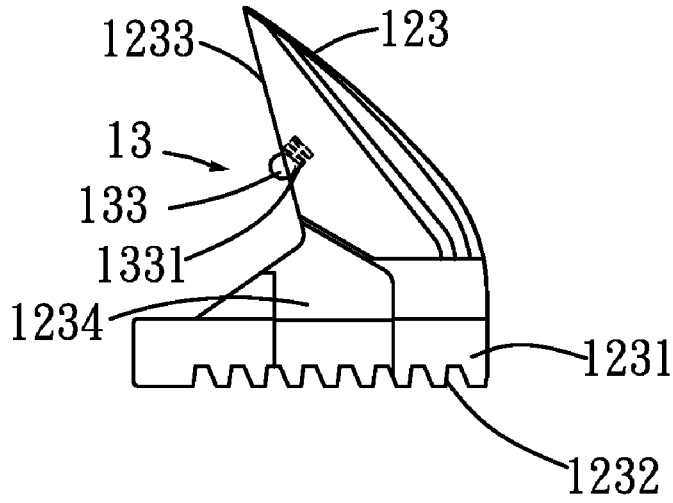
FIG. 9 shows a further embodiment of the present invention.
Figure 10:
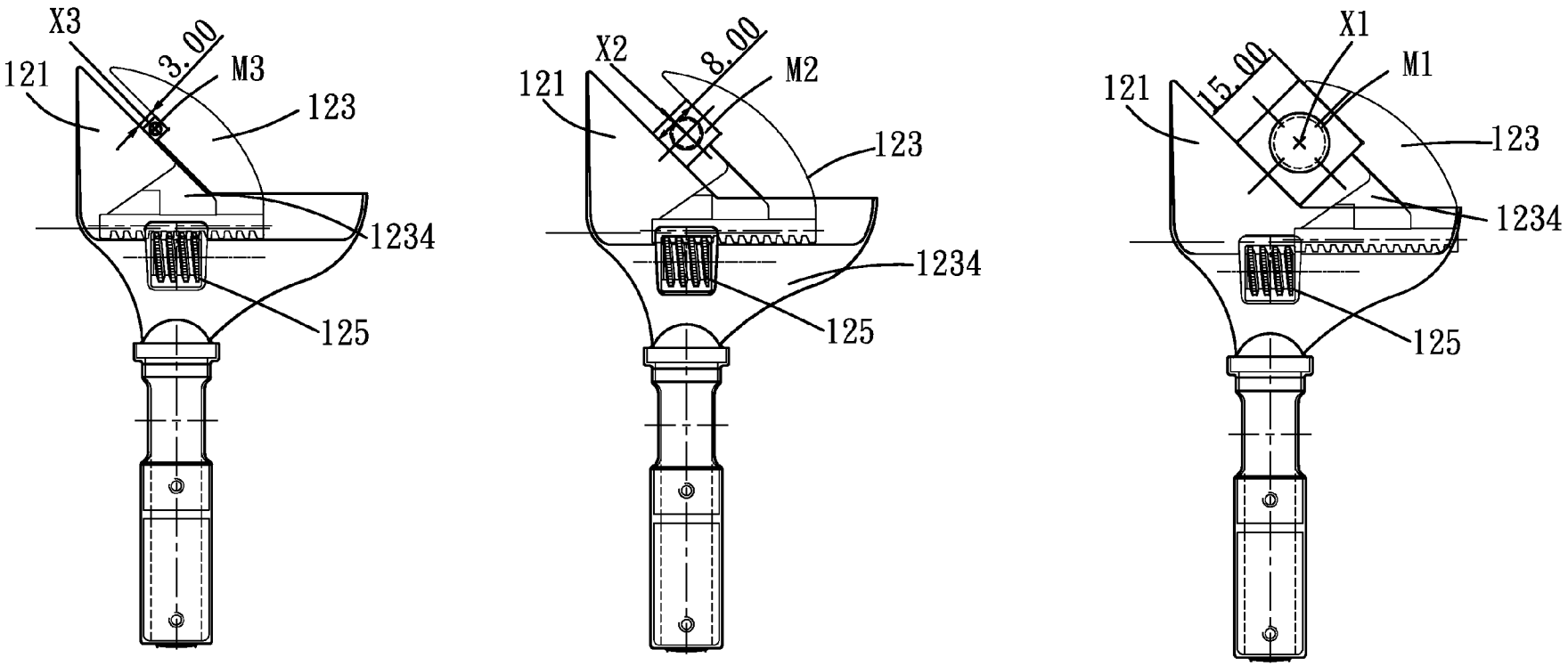
FIG. 10 further shows another embodiment of the present invention.
Figure 12:
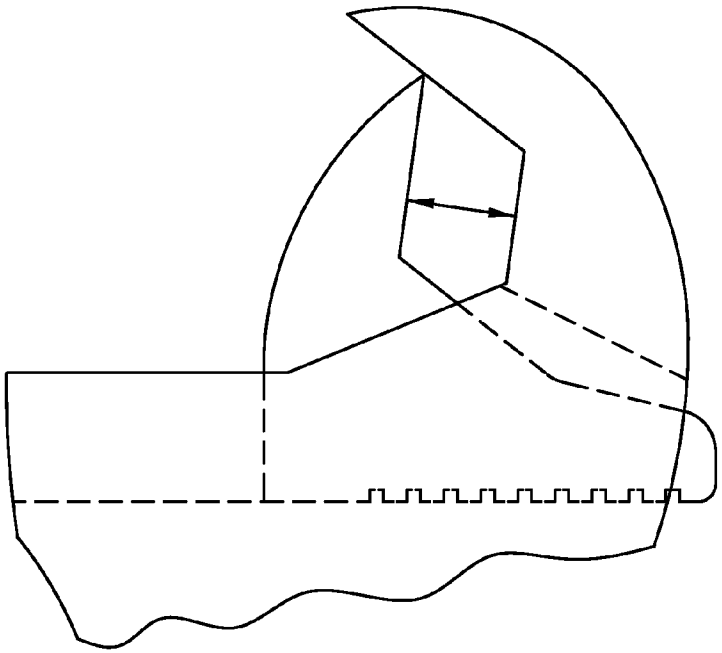
FIG. 12 PRIOR ART
FIG. 12 shows another operation state of the conventional tool of U.S. Pat. No. 5,595,098.
Figure 11:
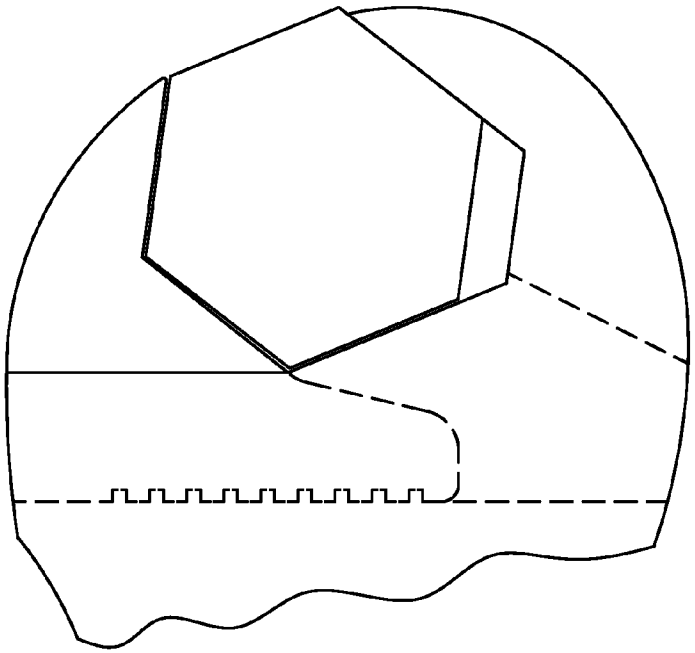
FIG. 11 PRIOR ART
FIG. 11 shows an operation state of a conventional tool of U.S. Pat. No. 5,595,098.

The positioning portion 13 may be a retaining projection 131 extending from the moveable jaw 123 (referring to FIG. 1), or a pin 132 (referring to FIG. 8), or an elastic device 1331 and a steel ball 133 (referring to FIG. 9). In the present invention, the angle between the positioning portion 13 and the engaging surface 1233 of the moveable jaw 123 is 120 degrees as illustrated in FIGS. 5 to 7, and the angle between the positioning portion 13 and the engaging surface 1233 of the moveable jaw 123 is 90 degrees as illustrated in FIG. 10, so as to clamp a tetragonal screw means.

Figure 5:
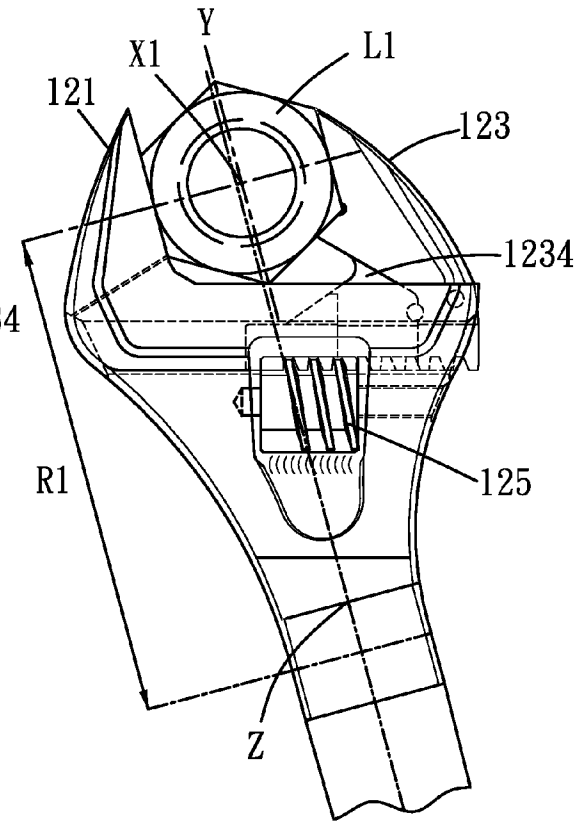
FIG. 5 shows the use of the present invention, where a screw device of 32 mm is applied to the adjustable spanner.

With reference to FIG. 5, a screw device L1 of 32 mm is clamped in the opening between the moveable jaw 123 and the fixed jaw 121. A length R1 from the central point X1 of the screw device L1 to the central point Z of one strain gauge 18 is 84.10 mm.

Figure 6:
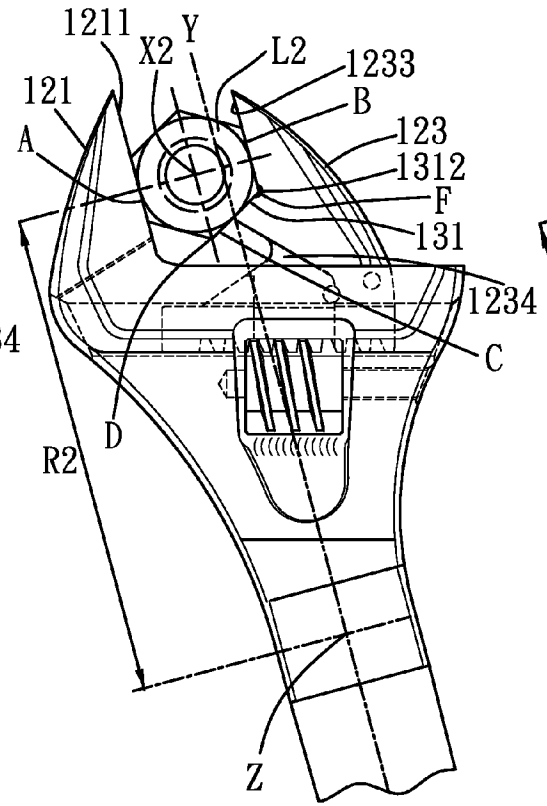
FIG. 6 shows the use of the present invention, where a screw device of 20 mm is applied to the adjustable spanner.

Referring to FIG. 6, when a smaller screw device L2 of 20 mm is clamped, the opening between the moveable jaw 123 and the fixed jaw 121 is reduced. However the retaining projection 131 is an inclined surface. The point C of the screw device L2 contacting the retaining projection 131 is higher than that of the screw device L1 contacting the retaining projection 131 so as to retain the length R2 from the central point Z to the central point X2 of the screw device L2 to be 84.10 mm.

In the present invention, the installation of the retaining projection 131 makes the distances from central point Z to central point X1 and to central point X2 are retained at the same value. The error is about 0.107% so that the error of the strain value is about 1% to 3%. Thus a precise strain measuring effect is achieved.

Referring to FIG. 7, in this example, the screw device L3 of 13 mm is used. In this example, the distance from the central point X3 to the central point Z is 84.13 mm. The error is about 0.143% so that the error of the strain value is about 1% to 3%. Thus the precision of the present invention cannot be achieved by any prior art.

Besides, referring to FIGS. 5 and 7, the side 1211 of the fixed jaw 121 and one side surface 1233 of the moveable jaw 123 are parallel to a central axis Y of the handle 14 so that the strain measure has an optimum value. The connection of the clamping surface 1233 of the moveable jaw 123 and the retaining projection 131 is formed with a round groove 1312. An apex F between the side B and C of the screw device is within the round groove 1312 so that the side C can be adhered on the retaining projection 131.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An adjustable spanner with electronic strain gauge function comprising:

a head; an fixed jaw extending from the head; and a sliding groove being transversally formed at one upper side of the head;

a handle connected to a lower side of the head;

at least one strain gauge;

a hollow connecting tube having one end connected to the handle; the hollow connecting tube being installed with an output display device having an operation unit and a display; a power source supplying power to the output display device; the output display device being electrically connected to the strain gauges;

a moveable jaw being comprised of an engaging surface, a sliding rod, and a reinforcing rib, a fixed positioning portion being extended from the engaging surface to face the opening between the fixed jaw and the moveable jaw so that a working area is formed among the engaging surface of the moveable jaw, the positioning portion and one side of the fixed jaw so as to clamp different-size screw means, a non-working area being located below the working area of the moveable jaw, and the reinforcing rib being extended downward from the positioning portion of the non-working area, so as to locate the positioning portion between the engaging surface of the moveable jaw and the reinforcing rib;

a sliding rod being received at the sliding groove of the fixed jaw so that the movable jaw can be adjusted to move toward or far away from the fixed jaw such that the distance between the fixed jaw and movable jaw can be adjusted randomly; wherein the distance from the connection of the positioning portion to the engaging surface of the moveable jaw is L, and the widest opening between the side of the fixed jaw and the engaging surface of the moveable jaw is S, the ratio of L to S is no more than 22%;

the height from the connection of the positioning portion and the engaging surface of the moveable jaw to a slidable slot is H, the ratio of H to S is within 35% to 49%;

as the position of the positioning portion is limited at clamping the screw means, the different-size screw means can be biased, so that during clamping the largest size of screw means and the smallest size of screw means, the error of the distance from the central point of the largest size of the screw means to the central point of the strain gauge and the distance from the central point of the smallest size of the screw means to the central point of the strain gauge is retained less then 5%.

2. The adjustable spanner with electronic strain gauge function as claimed in claim 1, wherein a surface of the positioning portion and a clamping surface of the moveable jaw is 90 to 120 degrees.

3. The adjustable spanner with electronic strain gauge function as claimed in claim 1, wherein the positioning portion is a retaining projection extended from the moveable jaw.

4. The adjustable spanner with electronic strain gauge function as claimed in claim 3, wherein a connection of the clamping surface of the moveable jaw and the retaining projection is formed with a round groove.

5. The adjustable spanner with electronic strain gauge function as claimed in claim 1, wherein the positioning portion is a pin.

6. The adjustable spanner with electronic strain gauge function as claimed in claim 1, wherein the positioning portion is formed of an elastic device and a steel ball.

7. The adjustable spanner with electronic strain gauge function as claimed in claim 1, wherein there are at least two strain gauges, and the strain gauges are installed at two sides of a neck of the handle.

8. The adjustable spanner with electronic strain gauge function as claimed in claim 1, wherein one side of the hollow connecting tube is formed with a first receiving groove for receiving an output display device; another end of the hollow connecting tube far away from the handle has a second receiving groove for receiving the power source.

9. The adjustable spanner with electronic strain gauge function as claimed in claim 1, wherein a plastic sleeve serves to enclose the hollow connecting tube for sealing the hollow connecting tube.

10. The adjustable spanner with electronic strain gauge function as claimed in claim 1, wherein one side surface of the fixed jaw and one side surface of the moveable jaw are parallel to a central axis of the handle so that the strain measure has an optimum value.

* * * * *